US008646115B1

(12) United States Patent
Baunach

(10) Patent No.: US 8,646,115 B1
(45) Date of Patent: Feb. 11, 2014

(54) VERSATILE GLOVE

(71) Applicant: Brandon Ly Baunach, Hillsboro, OR (US)

(72) Inventor: Brandon Ly Baunach, Hillsboro, OR (US)

( * ) Notice: Subject to any disclaimer, the term of this patent is extended or adjusted under 35 U.S.C. 154(b) by 0 days.

(21) Appl. No.: 13/913,372

(22) Filed: Jun. 7, 2013

(51) Int. Cl.
*A41D 19/00* (2006.01)

(52) U.S. Cl.
USPC ..... 2/161.1; 2/16; 2/158; 2/159; D29/117.1; D29/113; D29/123

(58) Field of Classification Search
USPC ..... 2/21, 163, 161.5, 169, 161.7, 161.6, 2/161.1, 160, 159, 161.3, 161.8, 158, 2/162, 161.2, 161.4, 164, 165, 166, 170, 2/907, 910, 917, 16; D2/614–623, 610; D29/117.1, 113, 114, 16.2, 117.2, 118, D29/120.1, 122, 123; D32/43; D24/190
See application file for complete search history.

(56) References Cited

U.S. PATENT DOCUMENTS

| | | | | | |
|---|---|---|---|---|---|
| 2,118,463 | A | * | 5/1938 | Eden | 2/163 |
| 2,253,710 | A | * | 8/1941 | Jones et al. | 2/163 |
| 2,299,118 | A | * | 10/1942 | Wheeler | 2/159 |
| 4,494,249 | A | | 1/1985 | Hansson | |
| 4,565,195 | A | | 1/1986 | Eisenberg | |
| 4,654,895 | A | * | 4/1987 | Peters | 2/161.1 |
| 4,704,743 | A | | 11/1987 | Thornell et al. | |
| 4,742,579 | A | | 5/1988 | Dunford | |
| 5,444,874 | A | | 8/1995 | Samelian et al. | |
| 5,516,150 | A | | 5/1996 | Goode et al. | |
| 5,517,693 | A | | 5/1996 | Noonan | |
| D416,374 | S | | 11/1999 | Lenhart | |
| 7,290,291 | B2 | | 11/2007 | Anderson et al. | |
| 7,934,270 | B2 | | 5/2011 | Kishino | |
| D649,717 | S | * | 11/2011 | Chorne | D29/117.1 |

OTHER PUBLICATIONS

Swany; Web Purchase Page; http://www.swanyamerica.com/p/artic; printed May 21, 2013 (1p).
Swany Legend II Toaster Mitten—Womens; http://www.rpk4.com/product/2012-2013-swany-arctic-toaster-mitten-womens.html; printed Jun. 7, 2013 (3pp).

* cited by examiner

*Primary Examiner* — Danny Worrell
*Assistant Examiner* — Khaled Annis
(74) *Attorney, Agent, or Firm* — Seed IP Law Group PLLC

(57) ABSTRACT

In various embodiments, a glove enables one wearing the glove temporary unsheathed use of one or more of a thumb and an index finger of a hand of the wearer on which the glove is worn. A slide fastener may run along the glove between a distal portion of the glove's index finger-covering portion and a distal portion of the glove's thumb-covering portion. The slide fastener, when opened over a particular amount, provides an opening in the glove to enable the wearer to extend one or more of the wearer's thumb and index finger outside the glove for temporary unsheathed use of the thumb and/or index finger. When the slide is fastener closed, this causes the glove to cover the thumb and index finger.

16 Claims, 7 Drawing Sheets

VERSATILE GLOVE

BRIEF SUMMARY

Provided is a glove that enables one wearing the glove to have temporary unsheathed use of one or more of a thumb and an index finger of the hand of the wearer on which the glove is worn. In one embodiment, the glove may comprise a hand-covering portion having at least a palmar side-covering portion, a dorsal side-covering portion, a thumb-covering portion, and an index finger-covering portion. A slide fastener runs along the glove between a distal portion of the index finger-covering portion and a distal portion of the thumb-covering portion. The slide fastener, when opened over a particular amount, provides an opening in the glove to enable the wearer to extend one or more of the thumb and index finger outside the glove for temporary unsheathed use of the one or more of the thumb and index finger. When the slide is fastener closed, this causes the glove to cover the thumb and index finger.

In one embodiment, the slide fastener may be positioned on the glove such that the slide fastener runs substantially along a curve of the glove between a radial side of the index finger-covering portion and an ulnar side of the thumb-covering portion. The slide fastener may run on the glove, should the glove be worn by the wearer, along an edge of thenar webbing of the hand between the thumb and index finger when the thumb is in a position fully extended away from the index finger. The slide fastener may run along a substantially palmar side of the index finger-covering portion and runs either along substantially an ulnar side of the thumb-covering portion or along substantially a dorsal side of the thumb-covering portion. The slide fastener may run along substantially a dorsal side of the index finger-covering portion and runs either along substantially an ulnar side of the thumb-covering portion or along substantially a palmar side of the thumb-covering portion.

In one embodiment, the slide fastener may run along substantially a palmar side of the thumb-covering portion and may run along substantially a radial side of the index finger-covering portion or along substantially a dorsal side of the index finger-covering portion. The slide fastener may run along substantially a dorsal side of the thumb-covering portion and runs either along substantially a radial side of the index finger-covering portion or along substantially a palmar side of the index finger-covering portion. The slide fastener may be configured to be opened by pulling of a slider of the slide fastener in a direction along the slide fastener from the distal portion of the index finger-covering portion to the distal portion of the thumb-covering portion. The slide fastener may be configured to be opened by pulling of a slider of the slide fastener along the slide fastener in a direction from the distal portion of the thumb-covering portion to a distal portion of the index finger-covering portion.

In one embodiment, the slide fastener may run from the distal portion of the index finger-covering portion to a proximal portion of the index finger-covering portion, along a radial side of the index finger-covering portion; run from the proximal portion of the index finger-covering portion to the proximal portion of the thumb-covering portion along a location on the glove that corresponds to, should the glove be worn by the wearer, an area on the hand between the thumb and index finger; and run from the proximal portion of the thumb-covering portion to the distal portion of the thumb-covering portion along an ulnar side of the thumb-covering portion.

In one embodiment, the slide fastener may be a zipper. The slide fastener may run along substantially a radial side of the index finger-covering portion and may run along substantially an ulnar side of the thumb-covering portion. The slide fastener that runs from the distal portion of the index finger-covering portion to the distal portion of the thumb-covering portion may run along a transition area of the glove between a proximal portion of the index finger-covering portion and a proximal portion of the thumb-covering portion at a location in the transition area such that the slide fastener makes a main substantially elevational bend in the transition area following a curvature of glove material in the transition area of the glove. The slide fastener that runs from the distal portion of the index finger-covering portion to the distal portion of the thumb-covering portion may be positioned along the transition area of the glove between the distal portion of the index finger-covering portion and the distal portion of the thumb-covering portion such that when the thumb-covering portion is in a fully extended position away from the index finger-covering portion, a radius of curvature of the main elevational bend in the slide fastener is substantially increased compared to when the thumb-covering portion is adducted toward the index finger-covering portion.

In one embodiment, the fully extended position of the thumb-covering portion away from the index finger-covering portion may be a position in which the thumb-covering portion is at or over an angle of about 70 to 90 degrees to the index finger-covering portion. The fully extended position of the thumb-covering portion away from the index finger-covering portion may be a position corresponding to a thumb of the wearer at about a maximum distance that the wearer can extend the thumb away from the index finger of the wearer. The fully extended position of the thumb-covering portion away from the index finger-covering portion may correspond to a thumb position in a rotational range from a thumb extension position to a thumb abduction position.

In one embodiment, the slide fastener may be positioned along the transition area of the glove between the distal portion of the index finger-covering portion and the distal portion of the thumb-covering portion such that, when the thumb-covering portion is adducted toward the index finger-covering portion, the slide fastener is not able to be manageably opened completely using one hand due a smallness of a radius of curvature of the main elevational bend in the slide fastener, and such that when the thumb-covering portion is in a fully extended position away from the index finger-covering portion, the slide fastener is able to be manageably opened completely with one hand due to an increase in the radius of curvature of the main elevational bend in the slide fastener when the thumb-covering portion is in a fully extended position away from the index finger-covering portion compared to the radius of curvature of the main elevational bend in the slide fastener when the thumb-covering portion is adducted toward the index finger-covering portion.

In one embodiment, a flap may be attached on the glove at a location where the slide fastener ends. The flap may be attached at either the distal portion of the thumb-covering portion or at the distal portion of the index finger-covering portion, and may be a flap under which one or more of a slider of the slide fastener and a pull handle of the slide fastener is able to be removeably tucked. The glove may further comprise a pull string attached to one or more of a slider of the slide fastener and a pull handle of the slide fastener. The glove may further comprise a flap at a location where the slide fastener ends, the flap attached at the distal portion of the thumb-covering portion or the distal portion of the index finger-covering portion and under which one or more of the slider and the pull handle is able to be removeably tucked. The flap may be of a size that allows the pull string to extend outside from underneath the flap a distance, should the glove be worn by the wearer, that enables the wearer to manageably grasp the pull string and open the slide fastener with the wearer's other hand while wearing an insulated glove on the other hand. In various embodiments, the glove may be one or more of: an insulated glove, a waterproof glove, a ski glove, a snowboarding glove and a winter sports glove, a glove integrated with an arm of a wet suit, a glove integrated with an arm of a dry suit.

In one embodiment, the glove may additionally have individual covering portions for a middle finger, a ring finger and a little finger. The glove may further comprise a flap running along the slide fastener underneath the slide fastener. The glove may further comprise a flap running along the slide fastener that substantially covers the slide fastener when the slide fastener is closed. The slide fastener may include a water resistant layer on the slide fastener that operates when the slide fastener is completely closed.

In one embodiment, the slide fastener may include a first slider of the slide fastener configured to be opened by pulling of the first slider of the slide fastener along the slide fastener in a direction from the distal portion of the index finger-covering portion to a proximal portion of the index finger-covering portion; and a second slider of the slide fastener configured to be opened by pulling of the second slider of the slide fastener along the slide fastener in a direction from the distal portion of the thumb-covering portion to a proximal portion of the thumb-covering portion.

A glove for enabling a wearer of the glove temporary unsheathed use of one or more of a thumb and an index finger of a hand of the wearer on which the glove is worn, may comprise: a hand-covering portion having at least a palm-covering portion, a thumb-covering portion, and an index finger-covering portion; and one or more of: a first slide fastener that runs between a distal portion of the index finger-covering portion along the glove and a proximal portion of the index finger-covering portion and a second slide fastener that runs between a distal portion of the thumb-covering portion along the glove and a proximal portion of the thumb-covering portion. The first slide fastener, when opened over a particular amount, provides an opening in the glove to enable the wearer to extend the index finger outside the glove for temporary unsheathed use of the index finger. When the first slide fastener is closed, this causes the glove to cover the index finger. The second slide fastener, when opened over a particular amount, provides an opening in the glove to enable the wearer to extend the thumb outside the glove for temporary unsheathed use of the thumb and, when the second slide fastener is closed, causes the glove to cover the thumb. In some embodiments, the glove may have both the first slide fastener and the second slide fastener.

The first slide fastener may stop at the proximal portion of the index finger-covering portion and the second slide fastener may stop at the proximal portion of the thumb-covering portion, such that each of the first slide fastener and the second slide fastener does not run along a location on the glove between a radial side of the proximal portion of the index finger-covering portion and an ulnar side of the proximal portion of the thumb-covering portion.

BRIEF DESCRIPTION OF THE DRAWINGS

Like reference numerals designate corresponding parts throughout the several views.

DETAILED DESCRIPTION

Figure 1:
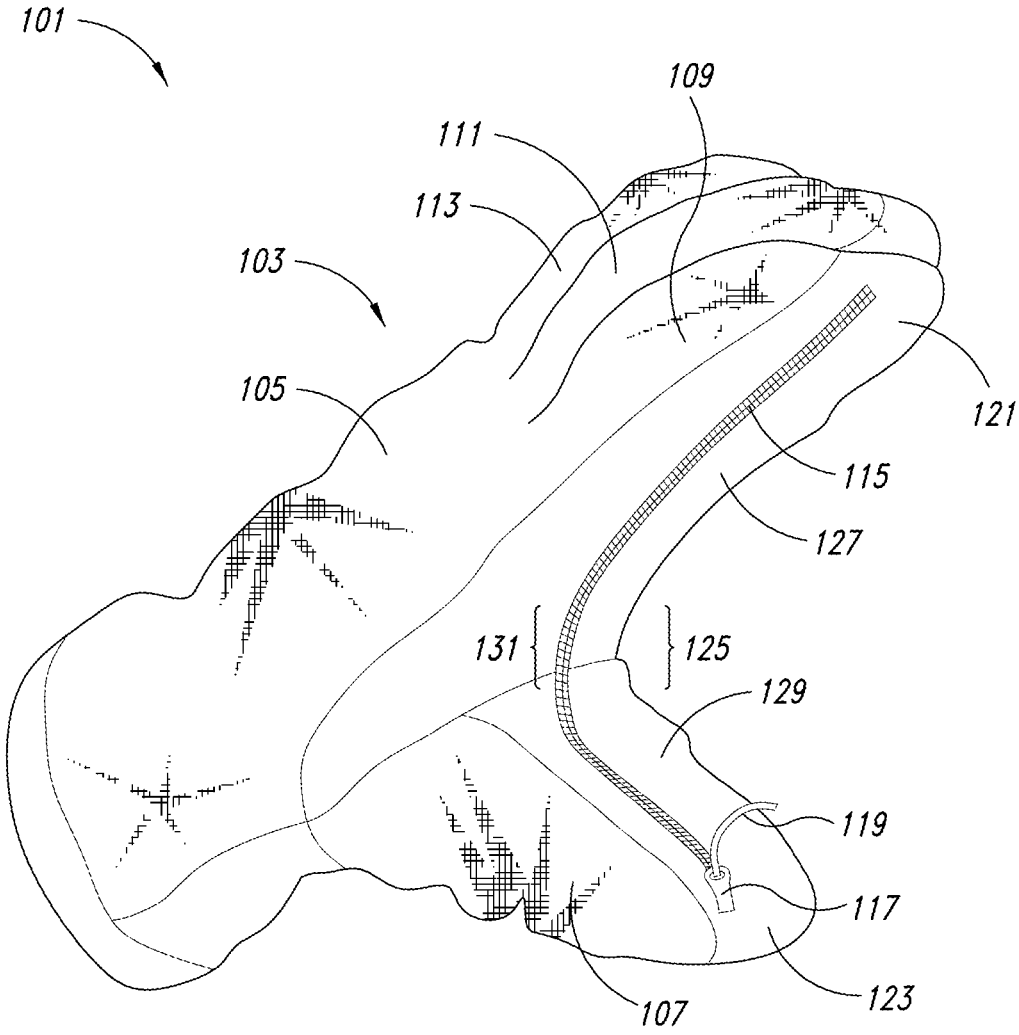
FIG. 1 is a perspective view of the radial side of a left-hand glove for enabling a wearer of the glove temporary unsheathed use of one or more of the wearer's thumb and an index finger of the hand on which the glove is worn, and showing the thumb-covering portion of the glove extended away from the index finger-covering portion, according to one non-limiting illustrated embodiment.

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures associated with slide fasteners, gloves, textile manufacturing and the construction and materials of slide fasteners and gloves have not been shown or described in detail to avoid unnecessarily obscuring descriptions of the embodiments.

Unless the context requires otherwise, throughout the specification and claims which follow, the word "comprise" and variations thereof, such as, "comprises" and "comprising" are to be construed in an open, inclusive sense, that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

The headings and Abstract of the Disclosure provided herein are for convenience only and do not interpret the scope or meaning of the embodiments.

It is often difficult to operate cell phones, cameras and other electronic equipment, retrieve things from pockets or perform other activities that involve fine finger dexterity when wearing insulated gloves. Taking one or both gloves off to perform such activities and then putting them back on is time consuming, inconvenient and cumbersome, especially while outside working in cold climates or while participating in outdoor winter sports, and may even cause one to lose the glove while riding a ski lift. For example, such activities may include those such as taking a picture, retrieving a cell phone, operating a device with a touch screen, answering a phone call, or retrieving and opening a trail map while riding the ski lift or while stopping temporarily on the mountain. Other such activities may include making a quick repair to, adjustment to, pushing buttons on or operating dials on equipment or machinery while working or doing other recreational activities. Also, removing the entire glove to perform such activities requires one to hold the removed glove or otherwise secure the removed glove while performing the activity, while also exposing the entire hand to the elements. Whereas, typically, dexterous use of just the index finger and thumb of one or both hands is sufficient to perform many of such activities.

Furthermore, for those in more extreme cold-weather environments, taking the entire glove off may increase the risk of exposure to frost bite and/or a decrease of overall body temperature. The process is further complicated and risk of exposure to frost bite is increased when an adequate seal between the wearer's glove and sleeve must be re-created each time the glove is put back on in order to prevent frost bite in colder environments with high winds.

Thus, provided is a glove that enables one wearing the glove temporary unsheathed use of one or more of a thumb and an index finger of a hand of the wearer on which the glove is worn.

For example, FIG. 1 is a perspective view of the radial side of a left-hand glove 101 for enabling a wearer of the glove 101 temporary unsheathed use of one or more of the wearer's thumb and an index finger of the hand on which the glove 101 is worn, according to one non-limiting illustrated embodiment. For example, the glove 101 may be, but is not limited to being: an insulated glove, a waterproof glove, a ski glove, a snowboarding glove, a winter sports glove, a work glove, a skydiving glove, a glove integrated with a jacket or shirt sleeve, a glove integrated with a jumpsuit sleeve, a glove integrated with a flight suit sleeve, a glove integrated with a sleeve of a wet suit, a glove integrated with a sleeve of a dry suit, a glove integrated with a skydiving suit, a gauntlet, etc.

The thumb-covering portion 107 of the glove 101 is shown in a position extended away from the index finger-covering portion 109 of the glove 101. In particular, shown is a hand-covering portion 103 of the glove 101 and shown as part of the hand-covering portion 103 is a dorsal side-covering portion 105 of the glove 101, a thumb-covering portion 107 of the glove 101, an index finger-covering portion 109 of the glove 101, a middle finger-covering portion 111 of the glove 101, and a ring finger-covering portion 113 of the glove 101. Also, shown is a slide fastener 115, a slide fastener pull handle 117 of the slide fastener 115, and a pull string 119 of the slide fastener pull handle 117. Hidden from view in the perspective view of the glove 101 shown in FIG. 1 are a palmar side-covering portion of the glove 101, a little finger-covering portion of the glove 101 and a slider of the slide fastener 115, that is attached to the slide fastener pull handle 117 of the slide fastener 115 for operation of the slide fastener 115.

As shown in FIG. 1, the slide fastener 115 runs along the glove material between a distal portion 121 of the index finger-covering portion 109 and a distal portion 123 of the thumb-covering portion 107. As shown in FIG. 1, the slide fastener 115 runs along the glove 101 only between the distal portion 121 of the index finger-covering portion 109 and the distal portion 123 of the thumb-covering portion 107. The slide fastener 115 is positioned on the glove 101 such that the slide fastener 115 runs substantially along a curve 125 of the glove between the radial side 127 of the index finger-covering portion 109 and an ulnar side 129 of the thumb-covering portion 107.

The slide fastener 115 operates to fasten together the sections of the glove 101 running along on opposite longitudinal sides of the slide fastener 115 and, if opened, provides an opening in the glove 101, between such sections of the glove 101, completely through to the inside of the glove 101. The slide fastener 115 is positioned and configured on the glove 101 such that the slide fastener 115, when opened over a particular amount, provides an opening (e.g., see FIG. 4) in the sections of the glove along the thumb-covering portion 107 and/or index finger-covering portion 109 to enable the wearer of the glove 101 to extend one or more of the wearer's thumb and index finger outside of the respective thumb-covering portion 107 and/or index finger-covering portion 109 for temporary unsheathed use of their thumb and/or index finger while the wearer has them extended outside the glove 101 (e.g., see FIG. 4).

As mentioned above, the thumb-covering portion 107 of the glove 101 is shown is a position extended away from the index finger-covering portion 109 of the glove 101. In particular, the slide fastener 115 may run along a path on the glove 101, as shown in FIG. 1, such that when the wearer's thumb is in such a position extended away from their index finger while wearing the glove 101, the path of the slide fastener 115 substantially follows the edge of the thenar webbing of the wearer's hand (i.e., the webbing between the wearer's thumb and index finger). In this manner, when the wearer extends their thumb away from their index finger while wearing the glove, the radius of curvature of the main elevational bend 131 in the slide fastener 115 is substantially increased compared to when the thumb-covering portion 107 is adducted toward, or otherwise drawn inward closer to or against the index finger-covering portion 109. Thus, the position of the slide fastener 115 causes the slide fastener 115 to be able to be manageably opened completely with one hand after (and also possibly before) the wearer extends their thumb outward while wearing the glove 101. This is due to an increase in the radius of curvature of the main elevational bend 131 in the slide fastener 115 when the thumb-covering portion 107 is in a fully extended position away from the index finger-covering portion 109, such as that shown in FIG. 1, mainly because there is a smaller change in the direction of the pulling force on the slide fastener pull handle 117 and/or the pull string 119 needed to slide a slider of the slide fastener 115 along the path of the slide fastener 115 to open and close the slide fastener 115 when the main elevational bend 131 in the slide fastener has a larger radius of curvature (i.e., is less sharp).

For example, the fully extended position of the thumb-covering portion 107 away from the index finger-covering portion 109 may be a position in which the thumb-covering portion 107 is at or over an angle of about 70 to 90 degrees to the index finger-covering portion 109, and this may correspond to all the thumb positions in the rotational range radially around the hand from a thumb extension position to a thumb abduction position. In some instances, this may be a position corresponding to a thumb of the wearer at about a maximum distance that the wearer can extend the thumb away from the index finger of the wearer.

When the wearer of the glove 101 has completed the activity using the thumb and/or index finger that they had extended outside the glove 101, the wearer may draw their thumb and/or index finger back into the respective thumb-covering portion 107 and/or index finger-covering portion 109 and then close the slide fastener 115 using their other hand by extending their thumb away from their index finger in the glove and pulling on the slide fastener pull handle 117 and/or slider pull string 119 with their other hand along the slide fastener 115 in the direction toward the distal portion 123 of the thumb-covering portion 107 to close the slide fastener 115. This causes the glove 101 to again cover the thumb and index finger.

The slide fastener 115 need not extend to the very tip of the index finger-covering portion 109 and/or the very tip of the thumb-covering portion 107, but extends far enough into the distal portion 121 of the index finger-covering portion 109 and distal portion 123 of the thumb-covering portion 107 such that the wearer may still remove their index finger and thumb through the opening in the glove 101 that is provided when the slide fastener 115 is completely open. The slide fastener 115 shown in the example embodiment of FIG. 1 is a zipper, but the slide fastener 115 may be any applicable and operable slide fastener. For example, in one embodiment, the slide fastener 115 may be any fastening device including of two flexible, interlocking stringers, with or without end stops, and a slider so arranged that by moving the slider along the stringers in one direction an opening is formed, and by moving it in the other the direction the opening is closed.

Also, in various embodiments, the slide fastener 115 may be, but is not limited to: any one of many slide fasteners using various types of sliders, any one of many slide fasteners using various types, chain types, any one of many slide fasteners using various types of tapes of the slide fastener, any one of many slide fasteners using various types of stops, a one-way slide fastener, a two-way slide fastener, a slide fastener of metallic, molded plastic and/or monofilament plastic construction, a slide fastener with metallic elements (teeth), a slide fastener with cast elements, a slide fastener with molded elements, a slide fastener with projections on which the slider of the slide fastener operates to reduce abrasion of the textile tape of the slide fastener, a plastic coil slide fastener, a slide fastener with coils that are woven or knitted into the textile tape of the slide fastener, a slide fastener with monofilament plastic elements that are of the meander type, which straddle the tape edge of the slide fastener, a snapslide slide fastener, a zip, a waterproof slide fastener, a water resistant slide fastener, a concealed or concealable slide fastener, a fastener using interlocking fastener elements, a slide fastener made of metal and/or plastic, a fastener using moveable slide buckles, a slide fastener using slide buckles with a moveable stud, a slide fastener using fixed bar slide buckles, a slide fastener using zinc die casted slide buckles, a slide fastener using casted slide buckles, a slide fastener using heavy stamped slide buckles, a slide fastener using wide mouth slide buckles, a closed type slide fastener, an open type slide fastener, a self-locking head slide fastener, an "invisible" type slide fastener, a knitted self-locking head slide fastener, etc.

Figure 2:
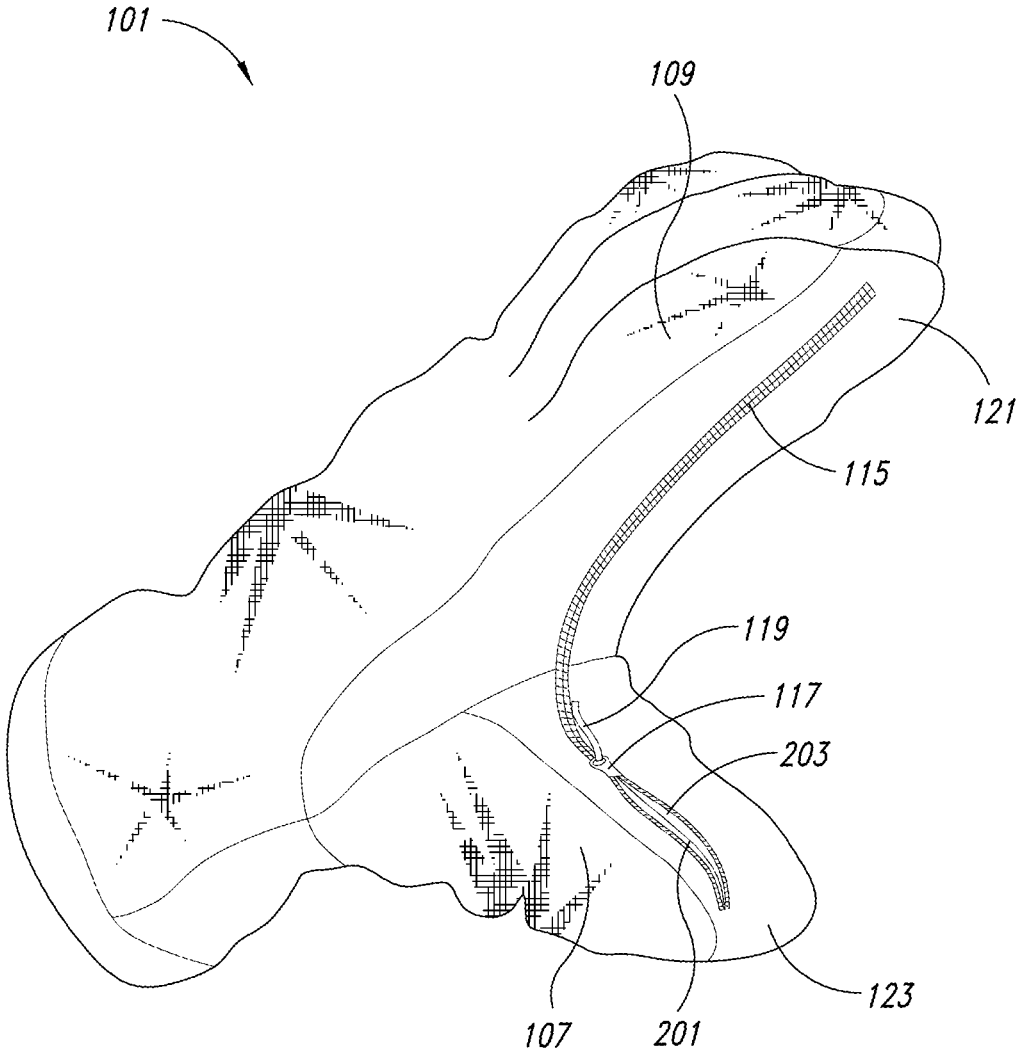
FIG. 2 is the same perspective view of the radial side of the glove as shown in FIG. 1, but shows the slide fastener of the glove partially opened, according to one non-limiting illustrated embodiment.

FIG. 2 is the same perspective view of the radial side of the glove 101 as shown in FIG. 1, but shows the slide fastener 115 of the glove 101 partially opened, according to one non-limiting illustrated embodiment. An opening 201 is shown in the glove 101 along the thumb-covering portion 107 due to the slide fastener 115 having been partially opened by the wearer pulling on the slide fastener pull handle 117 and/or the pull string 119. Also, an interior flap 203 is shown running longitudinally along an interior edge of the slide fastener 115 underneath the slide fastener 115 (e.g., just underneath the teeth of slide fastener 115) to provide added insulation when the slide fastener 115 is closed. Optionally, a flap (not shown) may also or instead run longitudinally along the slide fastener 115 on the surface of the glove 101 that is located above the slide fastener 115 such that it substantially covers the slide fastener 115 when the slide fastener 115 is closed.

Figure 3:
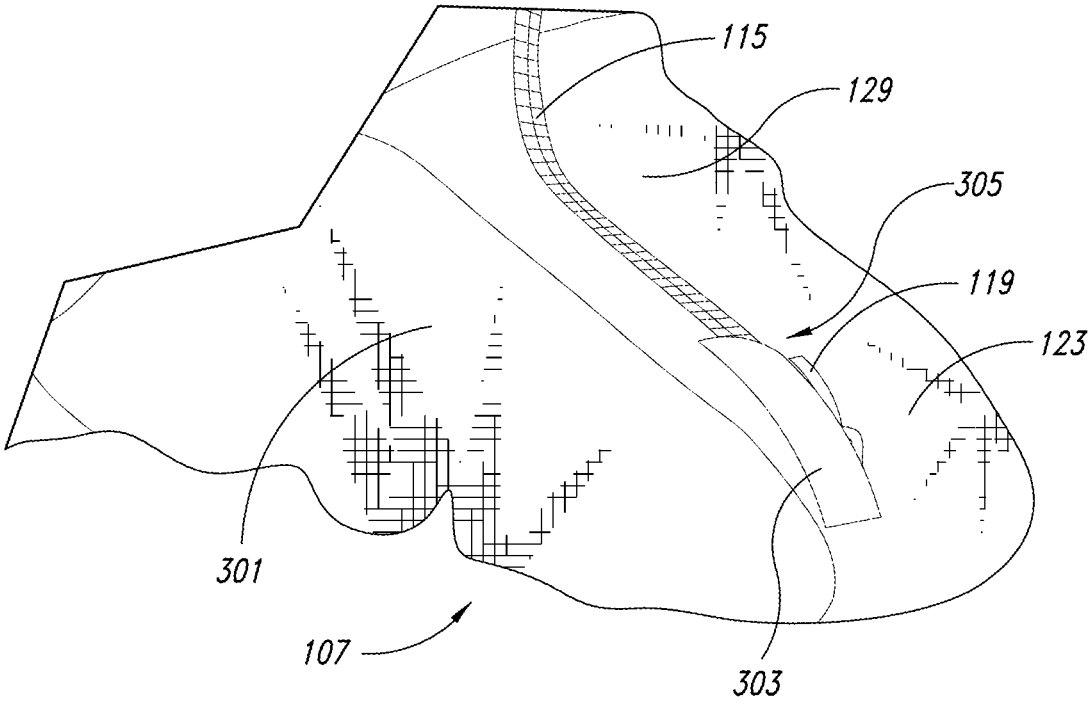
FIG. 3 is an enlarged partial perspective view of the distal end of the thumb-covering portion of the glove of FIG. 1, which shows the dorsal and ulnar side of the thumb-covering portion as in FIG. 1, but additionally shows a flap attached to the ulnar side of the thumb-covering portion with a slider and pull handle of the slide fastener tucked underneath the flap, according to one non-limiting illustrated embodiment.

FIG. 3 is an enlarged partial perspective view of the thumb-covering portion 107 of the glove 101 of FIG. 1, which shows the dorsal side 301 and ulnar side 129 of the thumb-covering portion 107 as in FIG. 1, but additionally shows a flap 303 attached to the ulnar side 129 of the thumb-covering portion 107. A slider (not shown) and pull handle (not shown) of the slide fastener 115 are tucked underneath the flap 303, according to one non-limiting illustrated embodiment. The slider and pull handle of the slide fastener 115 are able to be tucked underneath the flap 303 at the end of the slide fastener 115 via an opening 305 between the flap 303 and the slide fastener 115. However, the flap 303 is of a size such that the pull string 119 extends from underneath the flap 303 a distance that enables the wearer to manageably grasp the pull string 119 and open the slide fastener 115 with the wearer's other hand while wearing an insulated glove on the other hand. The flap may be positioned to help protect the slider and/or pull handle of the slide fastener 115 from wear and damage, help prevent the slider and/or pull handle of the slide fastener 115 from wearing down or damaging items with which the glove 101 comes in contact, and/or help prevent the slide fastener 115 from unintentionally opening. A similar flap (not shown) may be similarly located and positioned at the end of the slide fastener 115 at the distal end of the index finger-covering portion 109 for the same or similar purpose.

Figure 4:
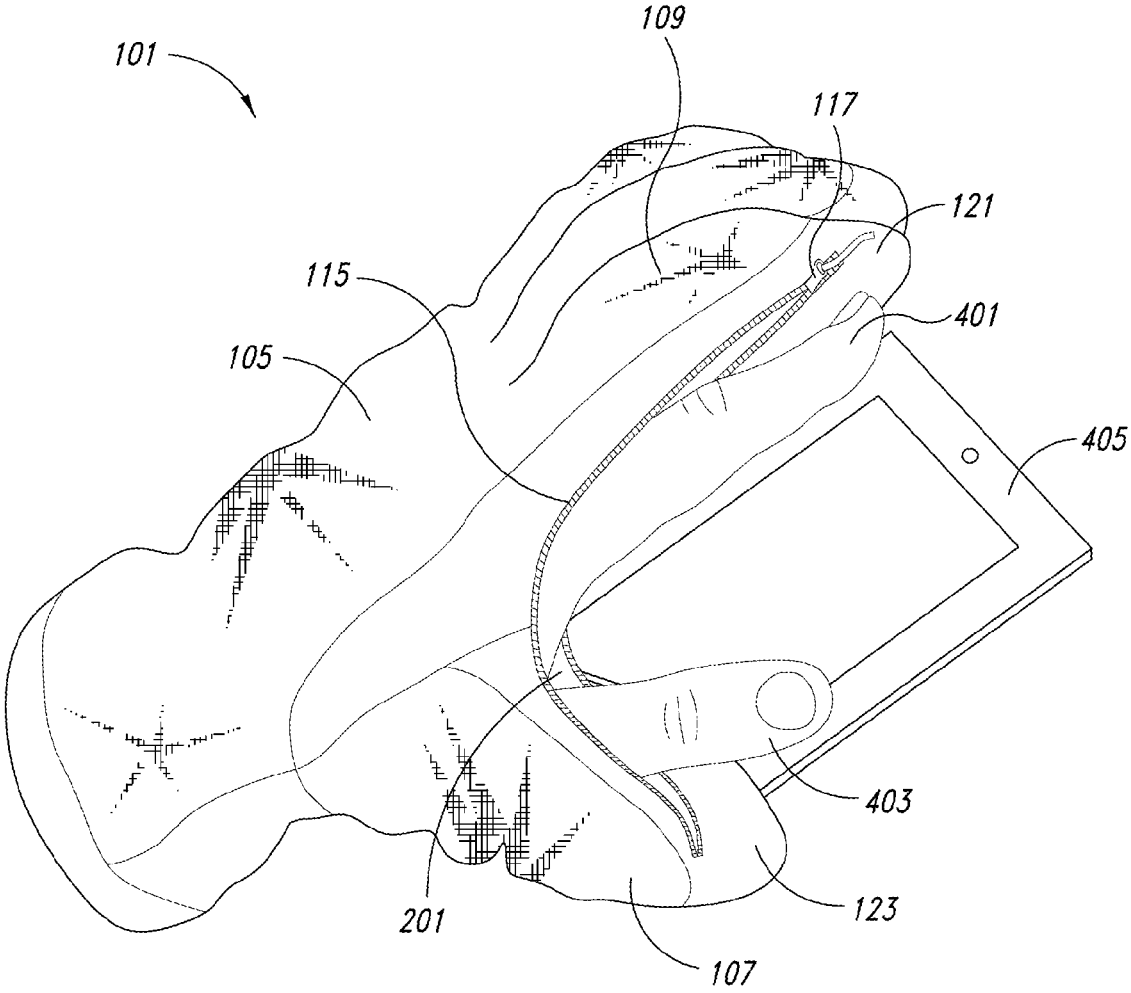
FIG. 4 is the same perspective view of the radial side of the glove as shown in FIG. 1, but shows the slide fastener of the glove completely opened with an index finger and thumb of the wearer extending outside the glove from an opening in the glove provided by the open slide fastener, according to one non-limiting illustrated embodiment.

FIG. 4 is the same perspective view of the radial side of the glove 101 as shown in FIG. 1, but shows the slide fastener 115 of the glove completely opened with an index finger 401 and thumb 403 of the wearer extending outside the glove 101 from an opening 201 in the glove provided by the opened slide fastener 115, according to one non-limiting illustrated embodiment. As shown in FIG. 4, the position of the slide fastener 115 on the glove 101 enables the wearer of the glove 101 temporary unsheathed use of one or more of their thumb 403 and an index finger 401 of their hand on which the glove 101 is worn. For example, by the wearer extending their index finger 401 and/or thumb 403 out from the opening 201 in the glove 101 provided by the opened slide fastener 115, the wearer can use their unsheathed thumb 403 and/or index finger 401 to retrieve, hold, and/or operate an electronic device, such as a smart phone 405, which may have a touch screen and/or other small buttons. In particular, the particular amount over which the slide fastener 115 may be opened may be that below which the opening 201 in the sections of the glove along the thumb-covering portion 107 and/or index finger-covering portion 109 does not enable the wearer of the glove 101 to extend one or more of the wearer's thumb 403 and/or index finger 401 outside of the respective thumb-covering portion 107 and/or index finger-covering portion 109 for temporary unsheathed use of the respective thumb and/or index finger.

In the non-limiting example embodiment shown in FIG. 4, the opening 201 extends from the distal portion 123 of the thumb-covering portion 107 to the distal portion 121 of the index finger-covering portion 109. However, the opening 201 and/or the length of the slide fastener 115 may be smaller or larger than that shown in FIG. 4 relative to the length of the thumb-covering portion 107 and/or the index finger-covering portion 109, as long as the opening 201 in the glove 101 provided by the opened slide fastener 115 is large enough to enable the wearer to extend one or more of their thumb 403 and index finger 401 outside the glove 101 through the opening 201. Also, in the non-limiting example embodiment shown in FIG. 4, the slide fastener 115 is opened by pulling the pull handle 117 toward the distal end 121 of the index finger-covering portion 109. However, in various other embodiments, the slide fastener 115 may operate in the opposite direction by pulling the pull handle 117 toward the distal end 121 of the thumb-covering portion 107.

Figure 5:
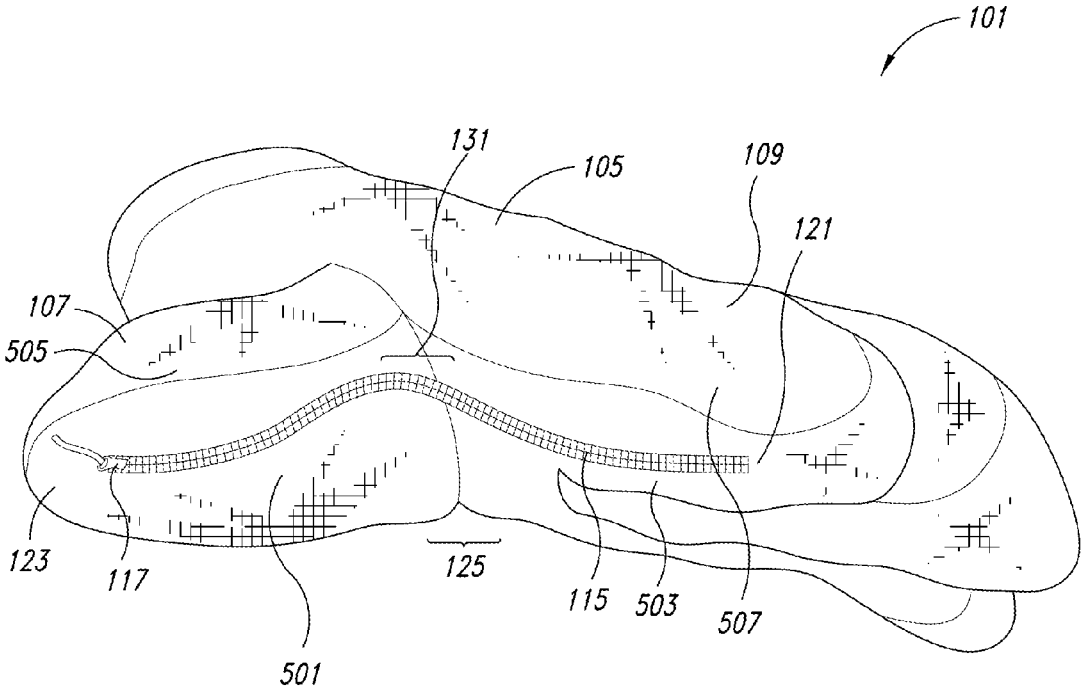
FIG. 5 is a perspective view of the distal end and palmar side of the glove of FIG. 1, with the thumb-covering portion of the glove in the same extended position away from the index finger-covering portion as in FIG. 1, but instead showing the slide fastener running along a portion of the palmar side of the index finger-covering portion and along a portion of the palmar side of the thumb-covering portion, according to one non-limiting illustrated embodiment.

FIG. 5 is a perspective view of the distal end and palmar side of the glove 101 of FIG. 1, with the thumb-covering portion 107 of the glove 101 in the same extended position away from the index finger-covering portion 109 as in FIG. 1, but instead showing the slide fastener 115 running along a portion of the palmar side 503 of the index finger-covering portion 109 and along a portion of the palmar side 501 of the thumb-covering portion 107, according to one non-limiting illustrated embodiment. In particular, the slide fastener 115 is positioned on the glove 101 such that the slide fastener 115 runs substantially along the curve 125 of the glove 101 (causing a main elevational curve 131 in the slide fastener 115) between the palmar side 503 of the index finger-covering portion 109 and palmar side 401 of the thumb-covering portion 107. This curve 125 of the glove 101 (and thus also the path of the slide fastener at the main elevational curve 131 in the slide fastener 115) between the index finger-covering portion 109 and the thumb-covering portion 107 may substantially correspond to the path of the edge of the thenar webbing of the wearer's hand between the wearer's thumb and index when the thumb is in a position fully extended away from the index finger. However, after the main elevational curve 131, the slide fastener 115 may run from the proximal portion of the index finger-covering portion 109 along the dorsal, palmar, or radial side of the index finger-covering portion 109 to the distal portion 121 of the index finger-covering portion 109 in various alternative embodiments, without making any sharp curves, turns or twists. Also, after the main elevational curve 131, the slide fastener 115 may run from the proximal portion of the thumb-covering portion 107 along the dorsal, palmar, or ulnar side of the thumb-covering portion 107 to the distal portion 123 of the thumb-covering portion 107 in various alternative embodiments, without making any sharp curves, turns or twists.

Figure 6:
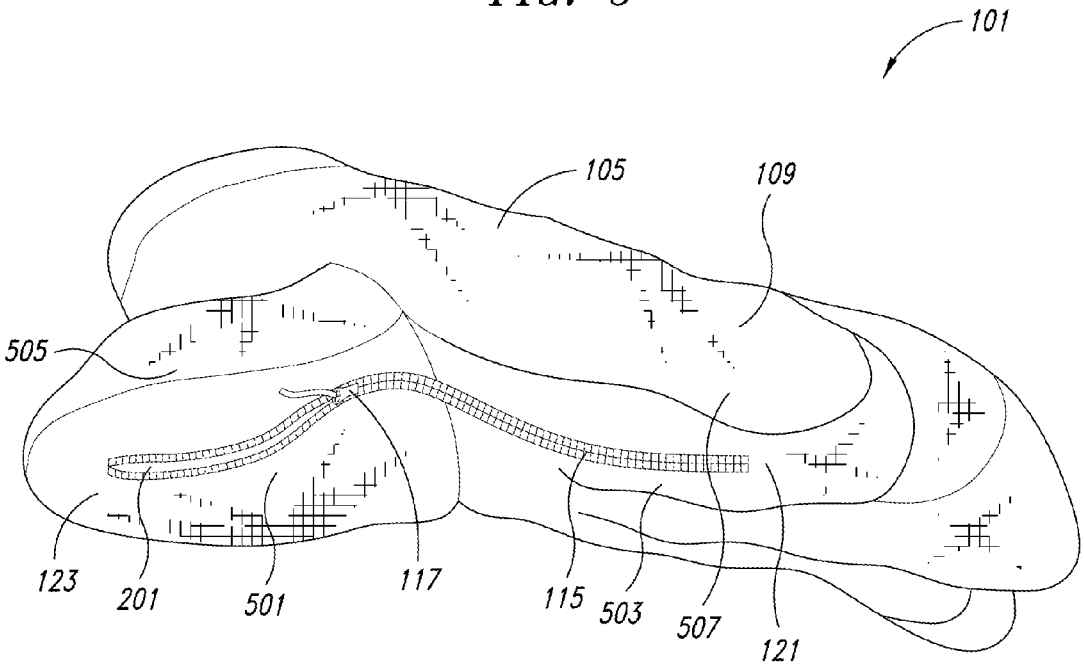
FIG. 6 is the same perspective view as in FIG. 5 of the distal end of the glove of FIG. 5, but showing the slide fastener of the glove partially open, according to one non-limiting illustrated embodiment.

FIG. 6 is the same perspective view as in FIG. 5 of the distal end and palmar side of the glove of FIG. 5, but showing the slide fastener 115 of the glove partially open along the palmar side 401 of the thumb-covering portion, 107, according to one non-limiting illustrated embodiment. Thus, the opening 201 is shown along the palmar side 401 of the thumb-covering portion 107, through which the wearer may extend their thumb.

Figure 7:
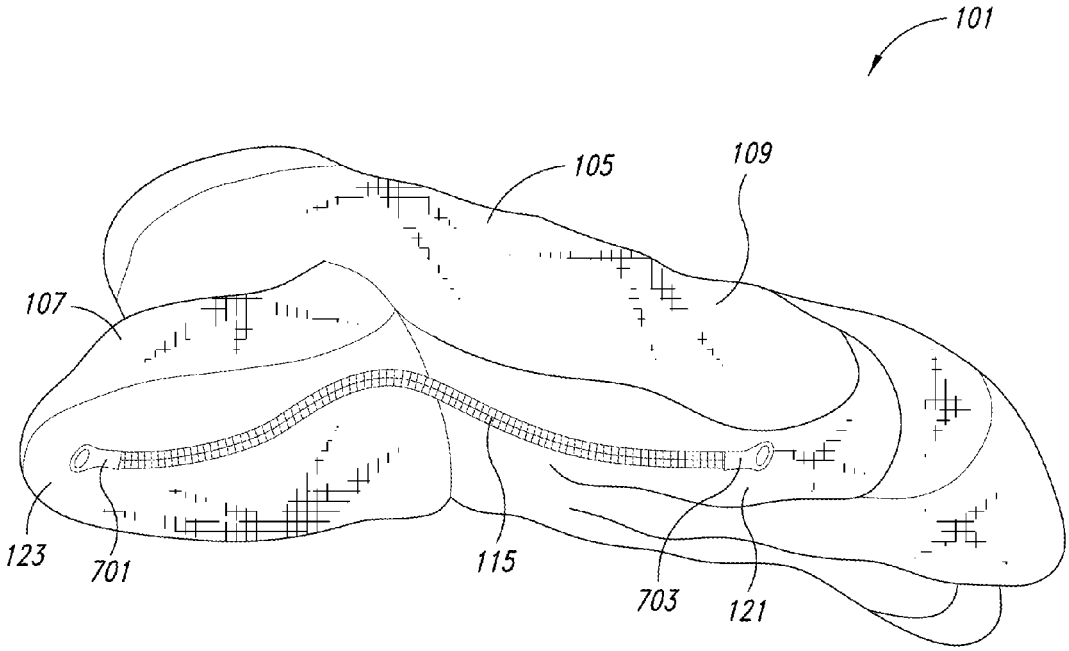
FIG. 7 is the same perspective view as in FIG. 5 of the distal end of the glove of FIG. 5, with the thumb-covering portion of the glove in the same extended position away from the index finger-covering portion as in FIG. 5, but with the slide fastener having two sliders instead of one slider and a larger pull handle attached to each slider instead of a pull string, according to one non-limiting illustrated embodiment.

FIG. 7 is the same perspective view as in FIG. 5 of the distal end of the glove 101 of FIG. 5, with the thumb-covering portion 107 of the glove in the same extended position away from the index finger-covering portion 109 as in FIG. 5, but with the slide fastener 115 having two sliders instead of one slider 117 and larger pull handles 701 and 703 attached to each slider (hidden by the larger pull handles 701 and 703 in FIG. 7) instead of a pull string 119, according to one non-limiting illustrated embodiment.

Figure 8:
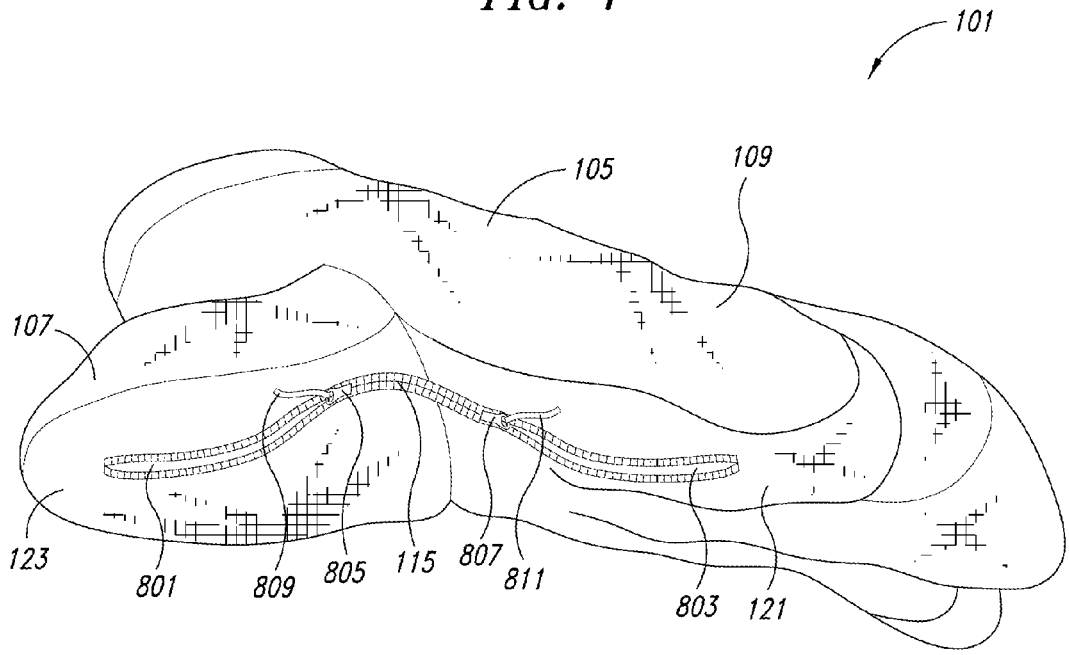
FIG. 8 is the same perspective view as in FIG. 7 of the distal end of the glove of FIG. 7, but showing the slide fastener partially opened on both ends of the slide fastener and both sliders having a pull string attached to smaller pull handles on each slider instead of the glove having a larger pull handle on each slider, according to one non-limiting illustrated embodiment.

FIG. 8 is the same perspective view as in FIG. 7 of the distal end of the glove 101 of FIG. 7, but showing the slide fastener 115 partially opened on both ends of the slide fastener 115, according to one non-limiting illustrated embodiment. Thus a first opening 801 is provided by the portion of the slide fastener 115 on the thumb-covering portion 107 through which the wearer may extend their thumb and a second opening 803 is provided by the portion of the slide fastener 115 on index finger-covering portion 109 through which the wearer may extend their index finger. Also, in the alternative embodiment shown in FIG. 8, smaller slider pull handles 805 and 807 each have a pull string attached to them instead of the glove 101 having larger pull handles 701 and 703 attached to each slider of the slide fastener 115.

Figure 9:
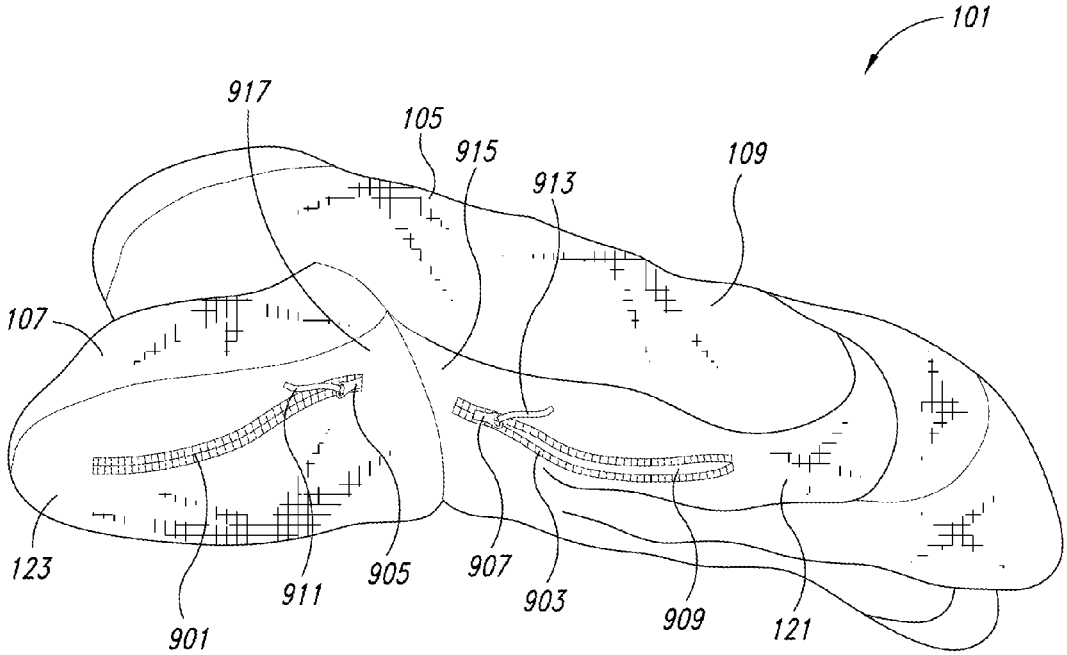
FIG. 9 is the same perspective view as in FIG. 5 of the distal end of the glove of FIG. 5, with the thumb-covering portion of the glove in the same extended position away from the index finger-covering portion as in FIG. 5, but instead having two slide fasteners on the glove, one that is partially open and runs along a portion of the index finger-covering portion, and another that is closed and runs along a portion of the thumb-covering portion, according to one non-limiting illustrated embodiment.

FIG. 9 is the same perspective view as in FIG. 5 of the distal end of the glove 101 of FIG. 5, with the thumb-covering portion 107 of the glove 101 in the same extended position away from the index finger-covering portion as in FIG. 5, but instead having two slide fasteners 901, 903 on the glove 101, according to one non-limiting illustrated embodiment. Slide fastener 903 is shown partially open and runs along a portion of the index finger-covering portion 109, providing an opening 909 through which the wearer may extend their index finger. Slide fastener 901 is shown closed and runs along a portion of the thumb-covering portion 107 and, when opened, provides an opening 1001 (see FIG. 10) through which the wearer may extend their thumb, according to one non-limiting illustrated embodiment.

Figure 10:
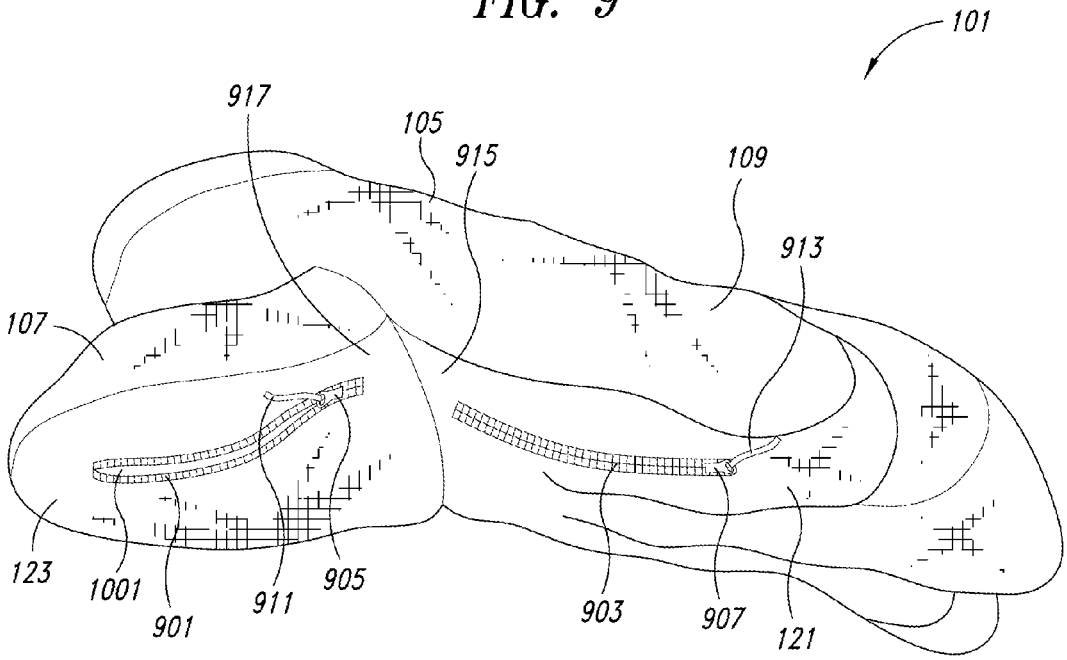
FIG. 10 is the same perspective view as in FIG. 9 of the distal end of the glove of FIG. 9, but instead showing the slide fastener that runs along a portion of the index finger-covering portion closed and the other slide fastener that runs along a portion of the thumb-covering portion partially open, according to one non-limiting illustrated embodiment.

FIG. 10 is the same perspective view as in FIG. 9 of the distal end of the glove 101 of FIG. 9, but instead showing the slide fastener 903 that runs along a portion of the index finger-covering portion 109 closed and the other slide fastener 901 that runs along a portion of the thumb-covering portion 107 partially open, according to one non-limiting illustrated embodiment. In particular, slide fasteners 901 is shown partially open and runs along a portion of the index finger-covering portion 109, providing an opening 1001 through which the wearer may extend their thumb. Thus, the wearer of the glove 101 may select one or both of the slide fasteners to open or close, depending on whether the wearer wants unsheathed use of either or both of their index finger and thumb.

A right-hand glove is also provided, which is constructed as a mirror image of the left hand glove as described and/or illustrated herein. The right-hand glove may be provided together as a set with the left-hand glove and/or such right-hand and left-hand gloves as described herein may be provided individually.

While various embodiments have been described hereinabove, it is to be appreciated that various changes in form and detail may be made without departing from the spirit and scope of the invention(s) presently or hereafter claimed.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

U.S. patent application Ser. No. 13/913,374, entitled "Versatile Glove" and filed of Jun. 7, 2013; U.S. patent application Ser. No. 29/457,291, entitled "Glove" and filed on Jun. 7, 2013; and U.S. patent application Ser. No. 29/457,292, entitled "Glove" and filed on Jun. 7, 2013 are each hereby incorporated by reference in their entireties.

The invention claimed is:

1. A glove adapted to enable a wearer of the glove to temporary unsheathed use of one or more of a thumb and an index finger of a hand of the wearer on which the glove is worn, comprising:

a hand-covering portion having at least a palmar side-covering portion, a dorsal side-covering portion, a thumb-covering portion, and an index finger-covering portion; and a slide fastener that runs along the glove between a distal portion of the index finger-covering portion and a distal portion of the thumb-covering portion, such that the slide fastener, when opened, provides an opening in the glove to an inside of the glove in the index finger-covering portion and the thumb-covering portion and, when the slide fastener is closed, causes the opening to be closed wherein the slide fastener that runs along the glove between the distal portion of the index finger-covering portion and the distal portion of the thumb-covering portion runs continuously along the glove only between the distal portion of the index finger-covering portion and the distal portion of the thumb-covering portion.

2. The glove of claim 1 wherein the slide fastener is positioned on the glove such that the slide fastener runs substantially along a curve of the glove between a radial side of the index finger-covering portion and an ulnar side of the thumb-covering portion.

3. The glove of claim 2 wherein the slide fastener runs on the glove, when the glove is worn by a wearer, along an edge of thenar webbing of the hand between the thumb and index finger when the thumb is in a position fully extended away from the index finger.

4. The glove of claim 2 wherein the slide fastener is configured to be opened by pulling of a slider of the slide fastener in a direction along the slide fastener from the distal portion of the index finger-covering portion to the distal portion of the thumb-covering portion.

5. The glove of claim 2 wherein the slide fastener is configured to be opened by pulling of a slider of the slide fastener along the slide fastener in a direction from the distal portion of the thumb-covering portion to a distal portion of the index finger-covering portion.

6. The glove of claim 1 wherein the slide fastener:

runs from the distal portion of the index finger-covering portion to a proximal portion of the index finger-covering portion, along a radial side of the index finger-covering portion, runs from the proximal portion of the index finger-covering portion to the proximal portion of the thumb-covering portion along a location on the glove that corresponds to, when the glove is worn by a wearer, an area on a hand of the wearer between the thumb and index finger, and runs from the proximal portion of the thumb-covering portion to the distal portion of the thumb-covering portion along an ulnar side of the thumb-covering portion.

7. The glove of claim 1 wherein the slide fastener is a zipper.

8. The glove of claim 1 wherein the slide fastener runs along substantially a radial side of the index finger-covering portion and runs along substantially a ulnar side of the thumb-covering portion.

9. The glove of claim 1 wherein the slide fastener that runs from the distal portion of the index finger-covering portion to the distal portion of the thumb-covering portion runs along a transition area of the glove between a proximal portion of the index finger-covering portion and a proximal portion of the thumb-covering portion at a location in the transition area such that the slide fastener makes a main substantially elevational bend in the transition area following a curvature of glove material in the transition area of the glove.

10. The glove of claim 9 wherein the slide fastener is positioned along the transition area of the glove between the distal portion of the index finger-covering portion and the distal portion of the thumb-covering portion such that, when the thumb-covering portion is adducted toward the index finger-covering portion, the slide fastener is not able to be manageably opened completely using one hand due to a smallness of a radius of curvature of the main elevational bend in the slide fastener, and such that when the thumb-covering portion is in a fully extended position away from the index finger-covering portion, the slide fastener is able to be manageably opened completely with one hand due to an increase in the radius of curvature of the main elevational bend in the slide fastener when the thumb-covering portion is in a fully extended position away from the index finger-covering portion compared to the radius of curvature of the main elevational bend in the slide fastener when the thumb-covering portion is adducted toward the index finger-covering portion.

11. The glove of claim 9 wherein the slide fastener that runs from the distal portion of the index finger-covering portion to the distal portion of the thumb-covering portion is positioned along the transition area of the glove between the distal portion of the index finger-covering portion and the distal portion of the thumb-covering portion such that when the thumb-covering portion is in a fully extended position away from the index finger-covering portion, a radius of curvature of the main substantially elevational bend in the slide fastener is substantially increased compared to when the thumb-covering portion is adducted toward the index finger-covering portion.

12. The glove of claim 11 wherein the fully extended position of the thumb-covering portion away from the index finger-covering portion is a position corresponding to a thumb of the wearer at about a maximum distance that the wearer can extend the thumb away from the index finger of the wearer.

13. The glove of claim 11 wherein the fully extended position of the thumb-covering portion away from the index finger-covering portion corresponds to a thumb position in a rotational range from a thumb extension position to a thumb abduction position.

14. The glove of claim 11 wherein the fully extended position of the thumb-covering portion away from the index finger-covering portion is a position in which the thumb-covering portion is at or over an angle of about 70 to 90 degrees to the index finger-covering portion.

15. The glove of claim 1 wherein the glove is one or more of: an insulated glove, a waterproof glove, a ski glove, a snowboarding glove and a winter sports glove, a glove integrated with an arm of a wet suit, a glove integrated with an arm of a dry suit.

16. The glove of claim 1 wherein the glove has individual covering portions for a middle finger, a ring finger and a little finger.

* * * * *

UNITED STATES PATENT AND TRADEMARK OFFICE

CERTIFICATE OF CORRECTION

PATENT NO. : 8,646,115 B1
APPLICATION NO. : 13/913372
DATED : February 11, 2014
INVENTOR(S) : Brandon Ly Baunach It is certified that error appears in the above-identified patent and that said Letters Patent is hereby corrected as shown below:

In the Claims

Column 11, Line 29:
"1. A glove adapted to enable a wearer of the glove to" should read, --1. A glove adapted to enable a wearer of the glove--.

Column 11, Line 44:
"closed wherein the slide fastener that runs along the" should read, --closed, wherein the slide fastener that runs along the--.

Signed and Sealed this
Twenty-first Day of April, 2015

Michelle K. Lee

Michelle K. Lee
*Director of the United States Patent and Trademark Office*